US009707576B2

(12) United States Patent
Hopper et al.

(10) Patent No.: US 9,707,576 B2
(45) Date of Patent: Jul. 18, 2017

(54) TRIGGER SPRAYER

(71) Applicants: SYNGENTA PARTICIPATIONS AG, Basel (CH); CANYON EUROPE LTD., Newtownabbey (IE)

(72) Inventors: Sarah Hopper, Basel (CH); Richard Dumont, Basel (CH); Neil Ryan, Belfast (IE); Edward Mitchell, Buckinghamshire (GB)

(73) Assignee: Syngenta Participations AG, Basel (CH)

( * ) Notice: Subject to any disclaimer, the term of this patent is extended or adjusted under 35 U.S.C. 154(b) by 0 days.

(21) Appl. No.: 14/409,244

(22) PCT Filed: Jul. 11, 2013

(86) PCT No.: PCT/IB2013/001982

§ 371 (c)(1),
(2) Date: Dec. 18, 2014

(87) PCT Pub. No.: WO2014/020438

PCT Pub. Date: Feb. 6, 2014

(65) Prior Publication Data

US 2015/0165454 A1 Jun. 18, 2015

Related U.S. Application Data

(60) Provisional application No. 61/670,338, filed on Jul. 11, 2012, provisional application No. 61/806,130, filed on Mar. 28, 2013.

(51) Int. Cl.

| | |
|---|---|
| ***B05B 1/28*** | (2006.01) |
| ***B05B 11/00*** | (2006.01) |
| *B05B 1/12* | (2006.01) |

(52) U.S. Cl.
CPC ..... *B05B 1/28* (2013.01); *B05B 11/0029* (2013.01); *B05B 11/3014* (2013.01); *B05B 1/12* (2013.01);
(Continued)

(58) Field of Classification Search
CPC ..... B05B 1/12; B05B 1/28; B05B 11/0029; B05B 11/3011; B05B 11/3014; B05B 11/3042; B05B 11/3057
See application file for complete search history.

(56) References Cited

U.S. PATENT DOCUMENTS 5,088,628 A * 2/1992 Knickerbocker ... B05B 11/0029 215/221
5,356,049 A * 10/1994 Harris ..... B05B 11/0005 222/382

(Continued)

FOREIGN PATENT DOCUMENTS

DE 10225087 A1 11/2003
JP 2000-233145 A 8/2000

(Continued)

OTHER PUBLICATIONS

International Search Report for Int. Application No. PCT/IB2013/001982 dated Jan. 16, 2014.

*Primary Examiner* — Frederick C Nicolas
*Assistant Examiner* — Bob Zadeh
(74) *Attorney, Agent, or Firm* — Brian D. McAlhaney

(57) ABSTRACT

According to one aspect of the present invention, there is provided a trigger actuated pump sprayer having a pump body, a trigger lever, a shroud and a nozzle, wherein the trigger actuated pump sprayer further comprises a toggle switch adaptor engaging the nozzle and having an operable portion within an opening in the shroud. In this way, the operable portion of the toggle switch adapter can be guided, controlled, regulated or otherwise manipulated within or (Continued)

around or otherwise because of the opening in the shroud, to remotely operate at least the nozzle of the trigger actuated pump sprayer.

8 Claims, 12 Drawing Sheets

(52) U.S. Cl.
CPC ..... *B05B 11/3011* (2013.01); *B05B 11/3057* (2013.01)

(56) References Cited

U.S. PATENT DOCUMENTS 5,704,521 A * 1/1998 Grogan ..... B05B 11/0027 222/153.06
5,706,984 A * 1/1998 Tada ..... B05B 1/12 222/182
5,716,008 A * 2/1998 Nottingham ..... B05B 11/0016 222/333
6,006,950 A * 12/1999 Watanabe ..... B05B 11/0029 222/153.13
6,186,366 B1 * 2/2001 Good ..... B05B 11/0005 222/153.14
6,536,686 B2 * 3/2003 Dukes ..... B05B 1/1654 239/333
6,752,330 B2 * 6/2004 DiMaggio ..... B05B 9/0861 239/332
8,517,221 B2 * 8/2013 Sweeton ..... B05B 11/303 222/153.13
2010/0276454 A1 * 11/2010 Espinoza ..... B05B 11/3059 222/153.13
2015/0165454 A1 * 6/2015 Hopper ..... B05B 11/0029 222/383.1
2016/0016188 A1 * 1/2016 Spang ..... B05B 1/12 222/153.13

FOREIGN PATENT DOCUMENTS

JP 2004-230326 A 8/2004
JP 2004-230347 A 8/2004
WO 2002/094451 A1 11/2002

* cited by examiner

TRIGGER SPRAYER

This application is a 371 filing of International Application No. PCT/IB2013/001982, filed Jul. 11, 2013, which claims priority benefit to U.S. Provisional Patent No. 61/670,338 filed Jul. 11, 2012 and U.S. Provisional Patent No. 61/806,130 filed Mar. 28, 2013, the contents of all of which are incorporated herein by reference.

FIELD OF THE INVENTION

The invention relates generally to the field of trigger actuated pump sprayers, and more particularly, to a shroud for a trigger actuated pump sprayer that reduces the exposure of the spray to the operator.

BACKGROUND OF THE INVENTION

Many known trigger actuated pump sprayers have a pump body of a molded thermoplastic material which includes a pump cylinder for the reception of a reciprocal pump piston which together therewith defines a variable volume pump chamber. The pump body includes an inlet passage leading to the pump chamber and a discharge barrel defining a discharge passage leading from the pump chamber and terminating in a nozzle on which a nozzle adjuster is mounted having a discharge orifice. A trigger lever is pivotally mounted to the pump body for actuating the pump piston upon a squeezing of the trigger, and a container closure cap is coupled to the pump body for mounting it to a container of liquid to be dispensed.

One drawback with trigger actuated pump sprayers is that during normal operation, an operator of such sprayers may be exposed to the liquid emanating from the nozzle. This can be hazardous, especially in cases where the sprayer is used to spray certain chemicals, such as pesticides, weed killers, etc. To reduce exposure of the liquid to the operator, conventional shrouds have been developed to cover the trigger actuated pump sprayers.

However, conventional shroud covers do not allow for adjustability of the nozzle adjuster typically found on most trigger actuated pump sprayers. Accordingly, there is a need for a shroud for a trigger actuated pump sprayer that reduces the exposure of the spray to the operator while permitting adjustment of the nozzle adjuster.

SUMMARY OF THE INVENTION

According to one aspect of the present invention, there is provided a trigger actuated pump sprayer comprising a pump body, a trigger lever, a shroud and a nozzle, wherein the trigger actuated pump sprayer further comprises a toggle switch adaptor engaging the nozzle and having an operable portion within an opening in the shroud.

In this way, the operable portion of the toggle switch adapter can be guided, controlled, regulated or otherwise manipulated within or around or otherwise because of the opening in the shroud, to remotely operate at least the nozzle of the trigger actuated pump sprayer assembly. This maintains a distance between the operator and the nozzle. That is, the toggle switch adapter allows the nozzle to be adjusted without the operator's direct contact with nozzle, thereby protecting or reducing the operator of the trigger actuated pump sprayer from exposure to the liquids being dispensed by the sprayer (such as pesticides or other chemicals).

The pump body may be any suitable unit, device, arrangement or means able to convey a portion of a fluid, generally a liquid, in an accompanying container, from said container to a point of discharge. Operation of the pump body is generally based on action of the trigger lever in a manner known in the art, and the pump body and trigger lever and their actions are not further described herein.

The nozzle of the trigger actuated pump sprayer is generally formed as a separable unit or piece, and is sometimes also termed a 'nozzle base'. The nozzle may also be formed integrally with one or more parts of the pump body. The nozzle is generally intended to provide the point of discharge of liquid from a barrel or other opening in the pump body. Nozzles and nozzle bases are well known in the art.

In one embodiment of the present invention, the toggle switch adapter mounts onto the nozzle. That is, the toggle switch adapter is separately formed, and includes at least one surface, optionally at least one shape, adapted to mount onto the nozzle such that discharge of fluid through the nozzle is then also discharged through the toggle switch adapter. This allows the manufacturer to provide a toggle switch adapter to existing nozzles or nozzle designs.

In an alternative embodiment, the toggle switch adapter and the nozzle are integrally formed. This may assist manufacturing by the reduction of forming one piece, where the integrally formed unit can fit with the remainder of the pump body.

Optionally, the toggle switch adapter is moveable by rotation. Such rotation is generally based on axial rotation about the longitudinal axis of the toggle switch adapter, generally being the direction of the liquid flow therethrough. Optionally, the operable portion of the toggle switch adapter moves through the opening in the shroud in the same manner. The operable portion of the toggle switch adapter operates at least the nozzle of the trigger actuated pump sprayer assembly, preferably, but not limited to, to provide at least one discharge setting of the assembly, preferably at least two different discharge settings of the assembly. Each setting could correspond to a specific nozzle operation, said operations comprising two or more of the group comprising: a nozzle closed setting, a jet discharge setting, and a spray discharge setting.

In one embodiment of the present invention, the opening is a cut. That is, a cut in or through the shroud, such that the operator of the assembly has access to at least the operable portion of the toggle switch adapter by means of the cut.

In a further embodiment, the cut defines at least first and second distinct discharge settings to which the operable portion is moveable. Optionally, the at least first and second discharge settings comprise opposing ends of the cut, such that the ends or extremes of the cut provide the furthest extent of possible movement of the operable portion within the cut. Such settings at opposing ends of the cut could be the same or different discharge operations of the nozzle. Optionally, the operable portion of the toggle switch adaptor is in a substantially horizontal orientation when moved to either of the opposing ends of the cut.

Optionally, the opening in the shroud could be provided with any number of discharge settings, preferably being distinct, but optionally also being continuous in one or more parameters, and able to provide at least two distinct types or forms of discharge, including no discharge, from the pump assembly. Such different parameters to provide different forms of discharge could include the rate, flow, pattern, volume, etc. or combinations of same, able to give the operator different possible uses of the pump assembly.

In one embodiment, the trigger actuated pump sprayer has a third discharge setting intermediate the opposing ends of the cut, and preferably being the default position for 'no discharge'. That is, to prevent discharge of liquid from the sprayer. The third setting is optionally in the form of a lock or locking mechanism, such that unintended or otherwise accidental movement of the trigger lever does not operate the pump body to cause unintended discharge of liquid.

Optionally, the operable portion of the toggle switch adaptor of the trigger actuated pump sprayer can protrude beyond the dimensions of the shroud, such as when moved to either of the opposing ends of the cut. Optionally, the operable portion remains within dimensions of the outer housing when in a 'no discharge' position or setting. Preferably, the operable portion remains within dimensions of the outer housing when moved to the third distinct setting.

In the present invention, it is intended that the shroud at least partly, optionally substantially or wholly engages with the toggle switch adapter so as to assist, hold or otherwise maintain the toggle switch adapter in engagement with the nozzle during its operation. In particular, the shroud provides distance between the operator and the nozzle.

In one embodiment of the present invention, the shroud extends around the toggle switch adapter. Preferably, the toggle switch adapter includes a cone or cone-like formation extending outwardly from that part of the toggle switch adapter engaging the nozzle. The cone may have any suitable shape, size or design, and may provide one or more particular patterns of spray for the discharge of liquid from the trigger actuated pump sprayer assembly. The cone also positively projects the discharge forwardly from the sprayer, and away from the operator.

In a further embodiment of the present invention, the shroud comprises a projection which extends to a location below the outlet end of the trigger actuated pump sprayer assembly. Where the toggle switch adapter includes a cone or cone like assembly, the projection preferably extends below the outlet end of the cone or cone like assembly. In this way, any drips or dripping of liquid from the discharge end of the toggle switch adapter fall onto the projection and away from the operator's hand which is generally extended around the trigger lever. Any drip or dripping from the projection of the shroud will also generally form beyond the operator's hand, preventing contact of the liquid with the operator's hand. This is particularly preferred where the liquid may be aggressive or otherwise distinctive.

According to another embodiment of the present invention, the shroud comprises a first clamshell and a second clamshell to form a combined clamshell. The first clamshell and the second clamshell may be formed separately, and include one or more complementary engagement pieces or portions to allow secure engagement of the first and second clamshells when combined around at least the toggle switch adapter, and preferably around the pump body.

In an alternative, the first clamshell and the second clamshell are conjoined. The first and second clamshells may be conjoined at any suitable part or portion, whilst able to be subsequently fully combined around at least the toggle switch adapter. In one arrangement, the first clamshell and the second clamshell are hingingly conjoined so as to fold together to form the combined clamshell. They may be hingingly conjoined at one or more edges or part of an edge, such that the first and second clamshells can move between 'open' and 'closed positions'.

According to a second aspect of the present invention, there is provided a shroud for a trigger actuated pump sprayer, the shroud comprising:

a switch adapter configured to movably engage an adjustable nozzle of the trigger actuated pump sprayer;

a first clamshell; and a second clamshell configured to attach to the first clamshell to form a combined clamshell, wherein the combined clamshell is configured to house a dispenser portion of the trigger actuated pump sprayer thereby providing a shroud around the trigger actuated pump sprayer, and further configured to operatively receive a portion of the switch adapter within an opening of the combined clamshell while engaged with the adjustable nozzle.

Briefly described, the disclosure relates to a shroud for a trigger actuated pump sprayer. In some implementations, the shroud includes a switch adapter configured to movably engage an adjustable nozzle of the trigger actuated pump sprayer. The shroud further includes a first clamshell and a second clamshell configured to attach to the first clamshell to form a combined clamshell. The combined clamshell is configured to house a dispenser portion of the trigger actuated pump sprayer thereby providing a shroud around the trigger actuated pump sprayer. The combined clamshell is further configured to operatively receive a portion of the switch adapter while engaged with the adjustable nozzle.

According to a third aspect of the present invention, there is provided a toggle switch adaptor adapted to engage the nozzle of a trigger actuated pump sprayer comprising a pump body, a trigger, a shroud and a nozzle; and having an operable portion within an opening in the shroud.

Embodiments and uses of the toggle switch adapter are described hereinabove, and apply equally to the toggle switch adapter in the third aspect.

Optionally, the toggle switch adapter and the nozzle are integrally formed.

According to a further aspect of the present invention, there is provided a pack comprising a trigger sprayer assembly as herein defined, and a liquid container. Generally, a pump assembly as described herein may include a closure cap having an engagement piece or unit, such as a threaded collar, able to engage a complementary engagement means such as a threaded neck, to attach and securely engage the liquid container with the pump body during use.

Various other objects and advantages of the invention will become apparent to those skilled in the art based on the following drawings and detailed description.

Figure 1:
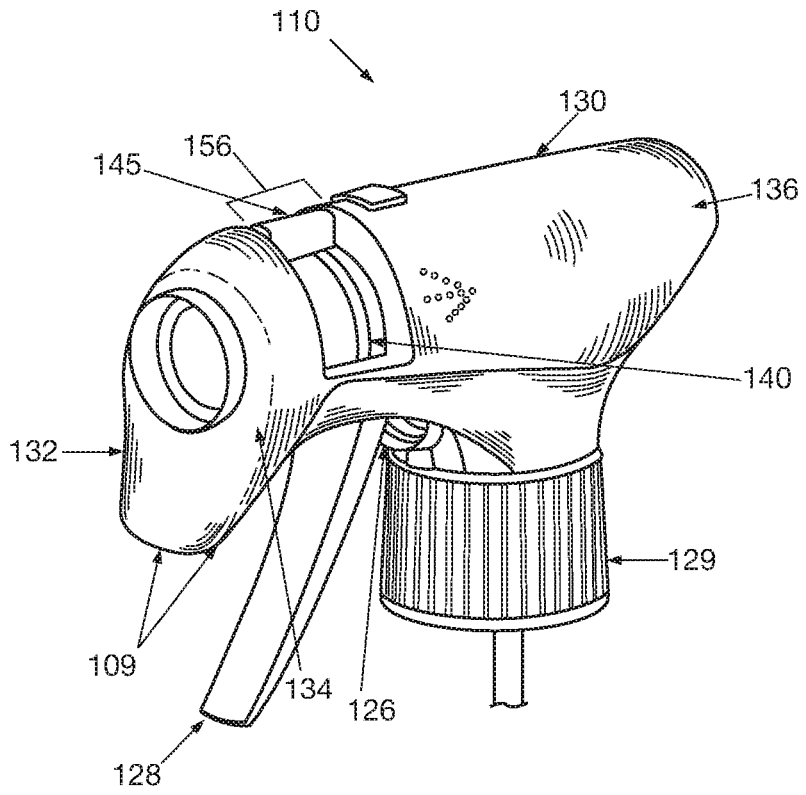
FIG. 1 is a perspective view of a shroud for a trigger actuated pump sprayer, according to one embodiment of the present invention.

Those skilled in the art will appreciate and understand that, according to common practice, the various features of the drawings discussed below are not necessarily drawn to scale, and that dimensions of various features and elements of the drawings may be expanded or reduced to more clearly illustrate the embodiments of the present invention described herein.

DETAILED DESCRIPTION

As illustrated in the drawings, a trigger actuated pump sprayer is described that reduces the exposure, to an operator of such sprayer, to a liquid emanating from a nozzle of such sprayer during its operation.

Figure 2:
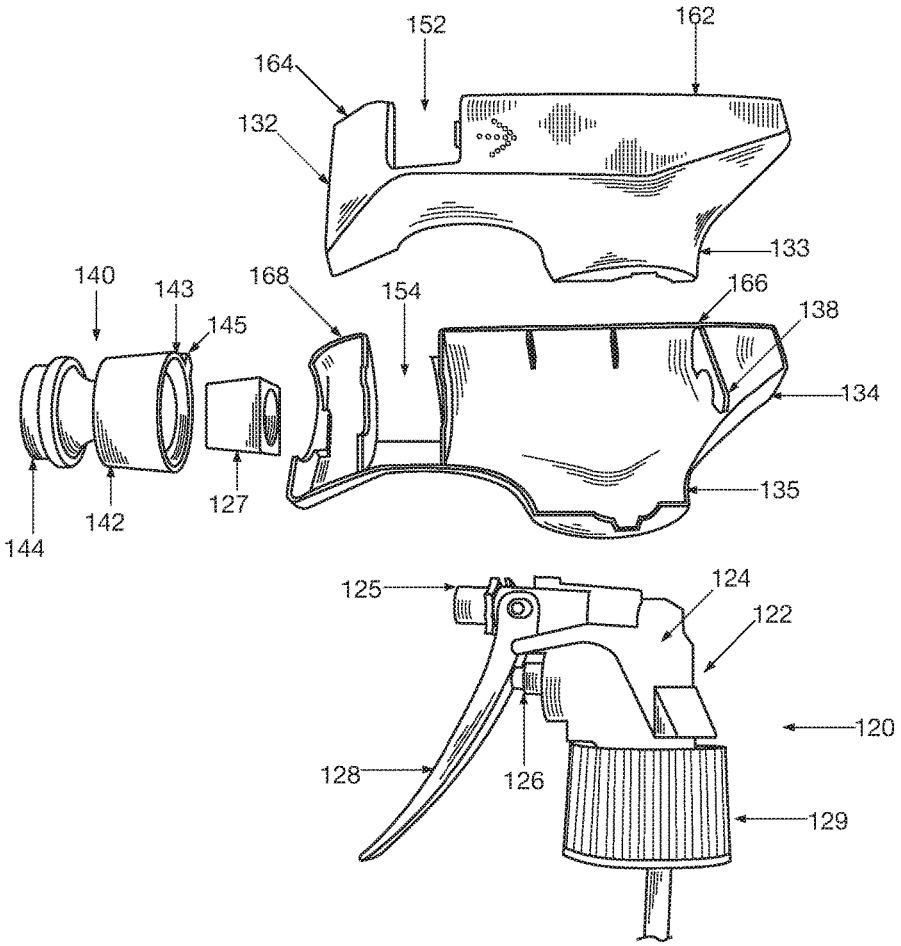
FIG. 2 is an exploded view of a shroud for a trigger actuated pump sprayer, according to one embodiment of the present invention.

As illustrated in FIGS. 1 and 2, the trigger actuated pump sprayer 120 has a shroud 110 comprising a first portion 130 and a second portion 140. First portion 130 includes a first clamshell 132 and a second clamshell 134. The first clamshell 132 and the second clamshell 134 are configured to attach to one another to form a combined clamshell 136. The combined clamshell 136 is configured to house a dispenser portion 122 of a trigger actuated pump sprayer 120 thereby providing a shroud around the trigger actuated pump sprayer 120. In some implementations, the first and second clamshells 132, 134 may be formed of injected molded polymer or plastic material. In some implementations, the clamshells may be formed of a thermoplastic polymer such as, polypropylene.

Figure 12:
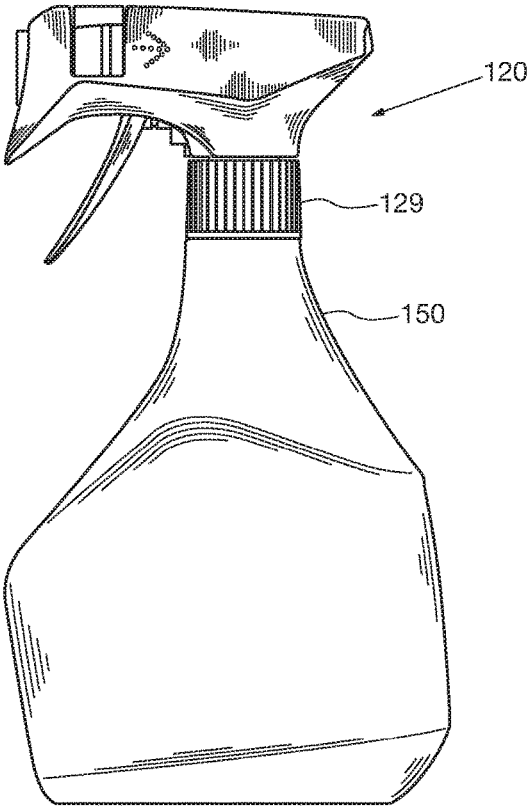
FIG. 12 illustrates a pack according to a further embodiment of the present invention.

The trigger actuated pump sprayer 120 ("sprayer 120") typically includes a dispenser portion 122, as illustrated in FIG. 2, for example. Dispenser portion 122 may include pump body 124 and a trigger lever 128 pivotally coupled to the pump body 124. Pump body 124 may include a pump cylinder (not otherwise illustrated) that is attached to piston 126. When the trigger lever 128 is pulled by the operator, piston 126 engages with the pump cylinder thereby causing liquid to be sprayed via a nozzle base 125 and adjustable nozzle 127, in a manner that is well-known in the art. Dispenser portion 122 may be coupled to a cap 129 for mounting the sprayer 120 to a container 150 as shown in FIG. 12 that holds liquid to be sprayed. During operation, liquid is drawn from the container 50 into the dispenser portion 122 and sprayed via the adjustable nozzle 127.

A conventional sprayer typically only includes the adjustable nozzle 127 attached to the nozzle base 125 (illustrated in FIG. 2 as being detached from nozzle base 125) to control the flow and/or intensity of the spray. For example, in some implementations, adjustable nozzle 127 provides an "on" and "off" setting for a conventional sprayer; in some implementations, adjustable nozzle 127 provides a "stream" setting, a "spray/mist" setting, and/or other settings for the sprayer as would be apparent; in some implementations, adjustable nozzle 127 provides a continuous adjustment between "stream" and "mist" as would be apparent; and/or in some implementations, a combination of the aforementioned settings may be used as would be apparent. Typically, adjustable nozzle 127 is generally manually rotated to alter the spray flow or intensity as would be appreciated. The operation of adjustable nozzles 127 on conventional sprayers is well-known and will not be further described.

Referring back to FIG. 2, second portion 140 of shroud 110 comprises a nozzle extension or toggle switch adapter 142 configured to movably engage the adjustable nozzle 127 of the sprayer 120. The switch adapter 142 is configured to receive the adjustable nozzle 127 at a proximal end 143. The switch adapter 142 includes a toggle or tab actuator 145 that simplifies manual manipulation of the switch adapter 142 to cause adjustment of the position of the adjustable nozzle 127, thereby controlling the flow and/or intensity of the spray. Rotation of the tab actuator 145 (clockwise and/or counterclockwise) causes movement of the switch adapter 142 and hence rotational movement of the adjustable nozzle 127 from one position or setting to another position or setting (for example, from off to spray, or from spray to stream, etc.). The switch adapter 142 includes an opening 147 (shown in FIG. 5, for example) at cone shaped distal end 144 through which the liquid is jetted or sprayed based on adjustment of the tab actuator 145 and the adjustable nozzle 127. The switch adapter 142 may be molded as a one-piece element. In some implementations, the switch adapter 142 may be formed of injected molded polymer or plastic material. In some implementations, the switch adapter 142 may be formed of a thermoplastic polymer such as, polypropylene.

As further illustrated in FIGS. 1 and 2, the combined clamshell 136 is configured to operatively receive a portion of the switch adapter 142 while engaged with the adjustable nozzle 127. The first clamshell 132 has a first cut 152 and the second clamshell 134 has a corresponding second cut 154 such that when the first clamshell 132 and the second clamshell 134 are attached, the first cut and second cut form a complete cut or an opening 156 in the combined clamshell 136. When assembled, the opening 156 of the combined clamshell 136 receives the portion of the switch adapter 142 with the tab actuator 145 so that the tab actuator 145 can be manually manipulated with ease. As such, the adjustable nozzle 127 may be adjusted even though it is covered with the switch adapter 142. In conventional sprayers, an operator manipulates the adjustable nozzle 127 directly which may expose the operator to chemicals deposited on the adjustable nozzle 127. However, the switch adapter 142 allows the adjustable nozzle 127 to be adjusted without the operator's direct contact with the adjustable nozzle 127 thereby protecting or reducing the operator of the trigger actuated pump sprayer from exposure to the liquids being dispensed by the sprayer (such as pesticides or other chemicals).

Shroud 110 may be assembled onto the typical trigger actuated pump sprayer sprayer 120 in the following manner. Switch adapter 142 may be coupled to adjustable nozzle 127 of sprayer 120 (i.e., while the adjustable nozzle 127 is attached to the nozzle base 125 of the sprayer 120). The first clamshell 132 and the second clamshell 134 may be positioned such that the portion of the switch adapter 142 with the tab actuator 145 aligns within the opening 156 and the lower portions 133, 135 of the first and clamshells 132, 134, respectively align with the either side of the dispenser portion 122. The first clamshell 132 and second clamshell 134 are then snapped together, thereby housing the dispenser portion 122 and providing a shroud around the trigger actuated pump sprayer 120. In some implementations, the second clamshell 134 includes a rib 138 at a rear portion 166 of the second clamshell 134, and the first clamshell 132 includes a recess (not otherwise illustrated in FIG. 2) at a rear portion 162 of the first clamshell 132. The recess of the first clamshell 132 is configured to receive rib 138. Rib 138 and the corresponding recess allow the rear portions 166, 162 of second clamshell 134 and the first clamshell 132 to snap together. The front portions 164, 168 of the first and second clamshells 132, 134 snap together when the switch adapter 142 is aligned within the opening 156. In some implementations, a lower sloping region of the combined front portions 164, 168 of the first and second clamshells 132, 134 form a drip guard region 109 (as shown in FIG. 1, for example). By providing a drip guard region 109, exposure of the operator of the trigger actuated pump sprayer 120 to the fluid being dispensed is avoided or at least reduced.

Figure 3A:
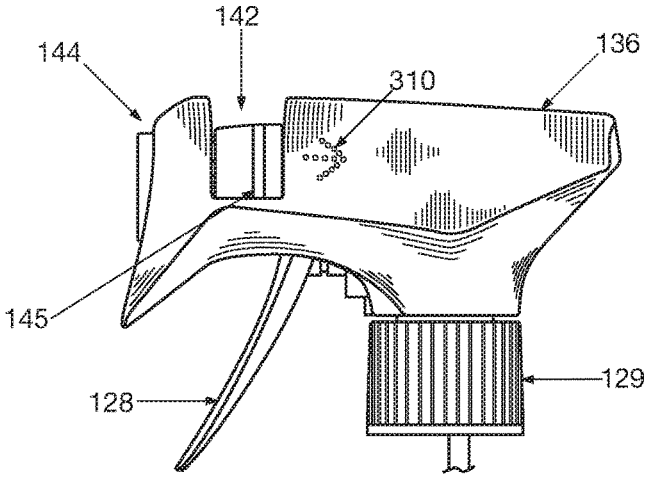
FIGS. 3A and 3B are side views of a shroud for a trigger actuated pump sprayer, according to one embodiment of the present invention.
Figure 3B:
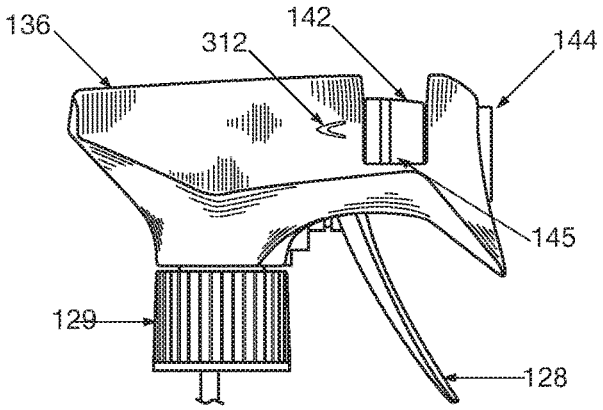
Figure 4:
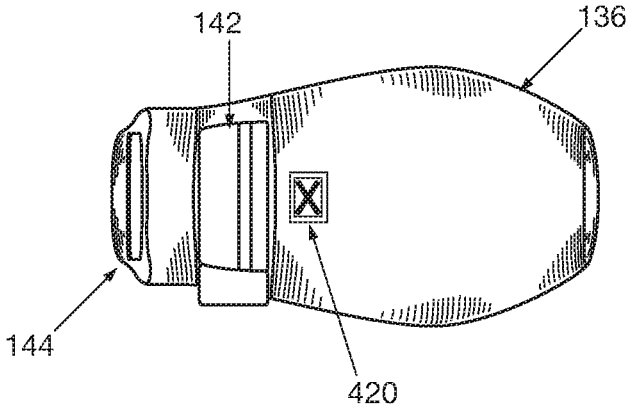
FIG. 4 is a top view of a shroud for a trigger actuated pump sprayer, according to one embodiment of the present invention.
Figure 5:
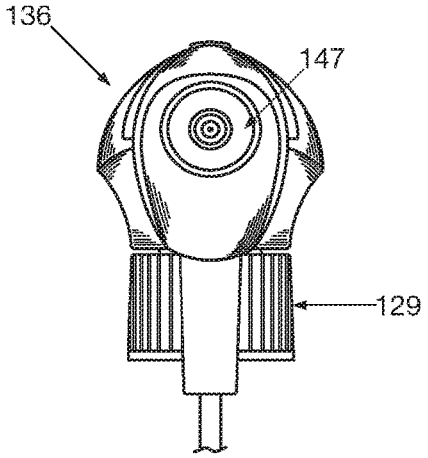
FIG. 5 is a front view of a shroud for a trigger actuated pump sprayer, according to one embodiment of the present invention.
Figure 6:
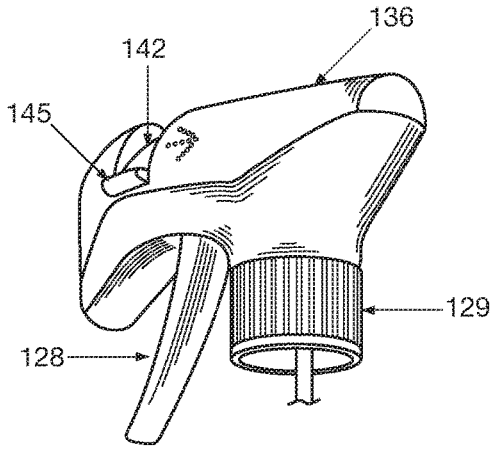
FIG. 6 is a back view of a shroud for a trigger actuated pump sprayer, according to one embodiment of the present invention.

FIGS. 3A and 3B illustrate side views of the shroud 110 and trigger actuated pump sprayer 120. FIG. 4 illustrates a top view of the shroud 110. FIGS. 5 and 6 illustrate front and back views of the shroud for the trigger actuated pump sprayer. As shown in FIGS. 3A, 3B, and 4, the surface of the combined clamshell 136 may include icons or other graphical representations for visually identifying various discharge settings for the sprayer: for example an "off" or "no discharge" setting may be depicted by icon 420, a "stream" setting may be depicted by icon 312, a "spray/mist" setting may be depicted by icon 310, and so forth.

Figure 7:
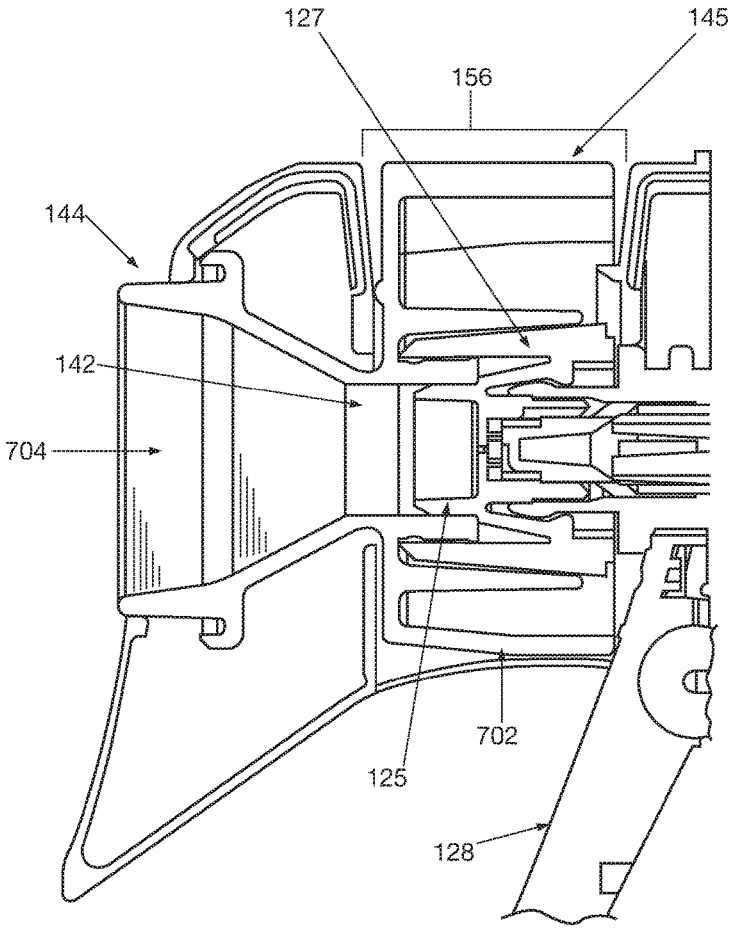
FIG. 7 is a cutout view of a switch adapter, according to one embodiment of the present invention.

FIG. 7 illustrates a cutout view of a portion of the switch adapter 142 being received within opening 156 while engaged with the adjustable nozzle 127. A tab actuator portion 702 of the switch adapter 142 (with tab actuator 145) receives the adjustable nozzle 127 and a cone-shaped portion 704 of the switch adapter 142 engages with the adjustable nozzle 127. The cone-shaped portion 704 acts as an extension to the adjustable nozzle 127. The extension is designed such that the liquid/spray/stream entering the cone-shaped portion 704 does not lose its structure provided by the adjustable nozzle 127. The switch adapter 142 is fitted with the adjustable nozzle 127 such that, as trigger lever 128 is pulled, any liquid emanating from the nozzle base 125/adjustable nozzle 127 runs forward towards the opening 147 in the cone-shaped portion 704 of the switch adapter 142 and not backward towards the nozzle/dispenser portion. As such, liquid emanating from the adjustable nozzle 127 is moved away from the adjustable nozzle 127 into cone-shaped portion 704 of switch adapter 142 and out through opening 147. This further ensures that the direct contact with the liquid being dispensed by the operator of the sprayer is avoided.

Figure 8:
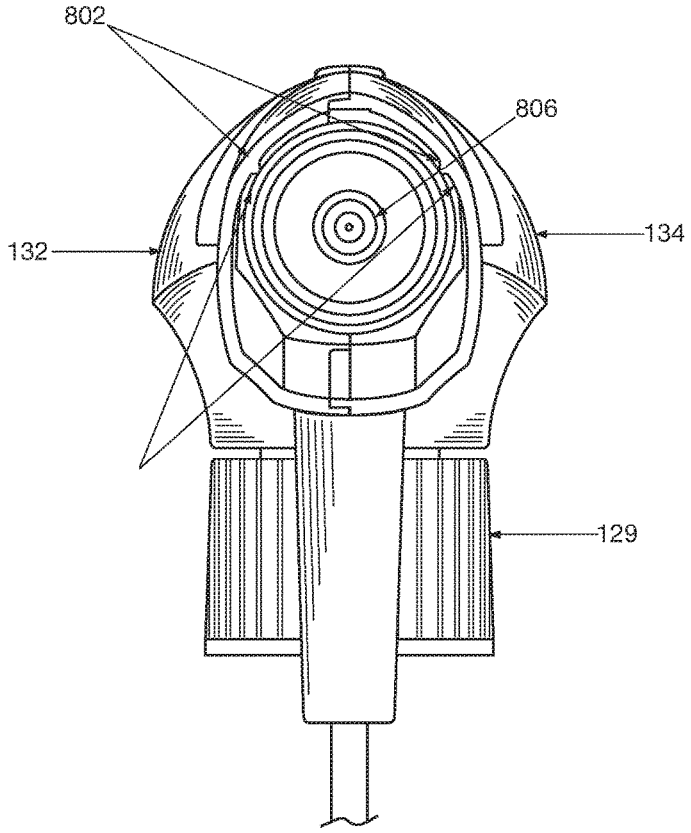
FIG. 8 is a front view of a shroud for the trigger actuated pump sprayer, according to one embodiment of the present invention.

In some implementations, distal end 144 of switch adapter 142 includes ribs 804 about the outer periphery of the switch adapter 142, as shown in FIG. 8 (which excludes the front portion of the shroud to show the ribs 804 etc.). Front portions 164, 168 of clamshells 132, 134 include corresponding ribs 802 that are configured to accommodate ribs 804 so that when the tab actuator 145 is moved from one position to another position (for example, off to spray, spray to stream, etc.) the ribs 802 and 804 snap together in a locked position. The ribs 802, 804 may be positioned to click into place when the switch adapter 142 is in an off position. When the tab actuator 145 is rotated, the force pulls the split line together. Also, visible from the front of the shroud is the C-shape 806 at the front of the nozzle base 125 while the adjustable nozzle is completely enclosed within the shroud.

Figure 9A:
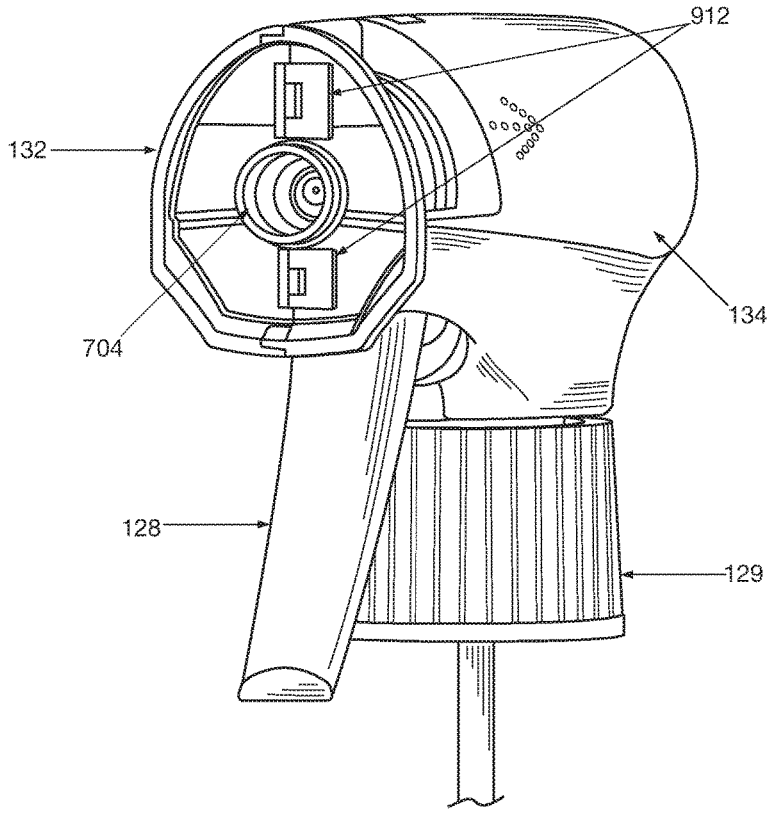
FIG. 9A is a front view of a shroud for the trigger actuated pump sprayer, according to one embodiment of the present invention.
Figure 9B:
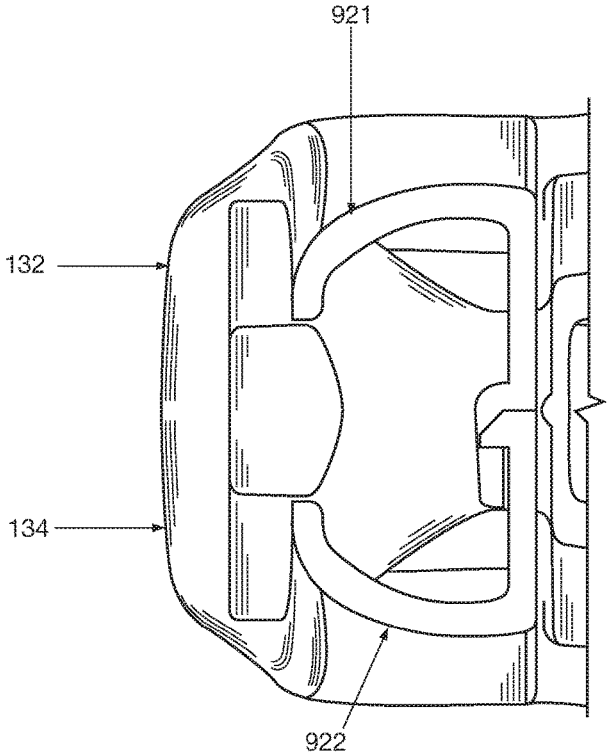
FIG. 9B illustrates a fastening mechanism for the shroud, according to one embodiment of the present invention.

In one embodiment, the front portions 164, 168 of clamshells 132, 134 may be attached by utilizing fastening clips 912, as shown in FIG. 9A (which again excludes the front portion of the shroud to show the clips 912, etc.). In one embodiment, a top clip 912 may be provided above cone shaped portion 704 and a bottom clip 912 may be provided below cone shaped portion 704. FIG. 9B illustrates in part cross-section through the shroud a fastening mechanism associated with top clip 912. For example, FIG. 9B illustrates portions of top clip 912 engaged with one another. Portion 921 of top clip 912 engages with portion 922 of top clip 912 to securely fasten front portions 164, 168 of clamshells 132, 134. It will be readily appreciated that a similar fastening mechanism may be employed for bottom clip 912 as well.

In some implementations, nozzle base 125/adjustable nozzle 127 of a conventional trigger actuated pump sprayer 120 may be modified to ensure a better fit with the switch adapter 142. This may be done to optimize the spray emanating from the sprayer in order to protect the operator from direct contact with the spray.

Figure 10A:
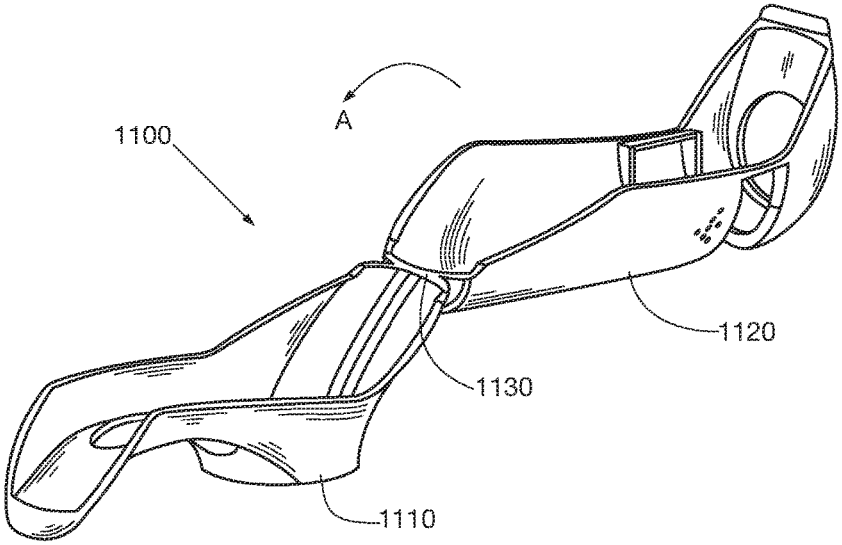
FIGS. 10A and 10B illustrate alternative variations of shrouds according to further embodiments of the present invention.
Figure 10B:
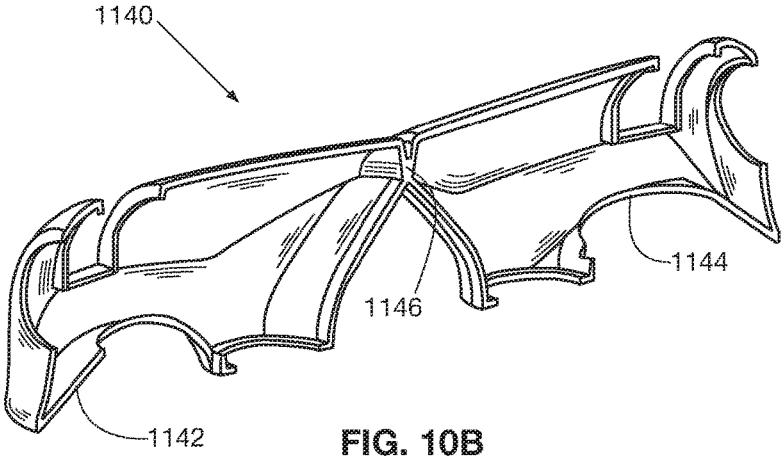

FIG. 10A illustrates a first alternative shroud 1100 wherein the first clamshell 1110 and the second clamshell 1120 are conjoined. They are hingingly conjoined by a bridging portion 1130, so as to fold together in the direction of arrow A to form a combined clamshell in the form of a shroud, in the same matter as the combined clamshell 136 shown in FIG. 1 etc. In this way, the first and second clamshells 1110, 1120 can be formed as a single integral piece, for example by injection moulding and the like, ready for forming around a pump body etc. as described hereinabove. FIG. 10B shows a second alternative shroud 1140 comprising a first clamshell 1142 and a second clamshell 1144, conjoined via a bridging piece 1146 so as to be hingingly conjoined. Like the first alternative shroud 1100 shown in FIG. 10A the second alternative shroud 1140 can be formed by folding the first and second clamshells 1142, 1144 together via the bridging piece 1146 around a pump body, etc.

The skilled man can see other possible locations for bridging pieces between complementary first and second clamshells at other locations.

Figure 11A:
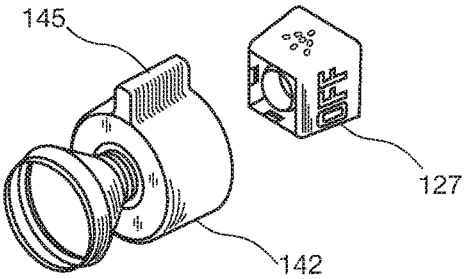
FIGS. 11A and 11B illustrate toggle switch adaptors according to further embodiments of the present invention.

FIG. 11A illustrates the toggle switch adapter 142 and tab actuator 145 adapted to engage the nozzle 127 of a trigger actuated pump sprayer, with the tab actuator 145 being the operable portion for location within an opening of a shroud in the manner discussed hereinabove.

Figure 11B:
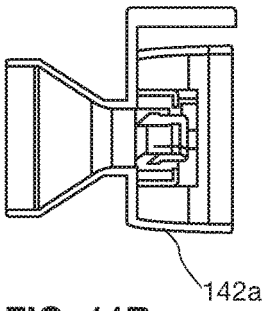

FIG. 11B illustrates a toggle switch adapter 142 integrally formed with the nozzle 127 of a trigger actuated pump sprayer, and ready for engagement with the remainder of the pump body, etc. as described hereinabove.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore the scope of the present disclosure shall be construed to cover various modifications, combinations, additions, alterations, etc. above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

The invention claimed is:

1. A trigger actuated liquid pump sprayer comprising a pump body, a trigger lever, a shroud and a nozzle, wherein the trigger actuated liquid pump sprayer further comprises a toggle switch adaptor engaging the nozzle and having an operable portion within an opening in the shroud, wherein the shroud extends around the toggle switch adaptor and comprises a drip guard which extends to a location below a distal end of the toggle switch adaptor, and wherein the toggle switch adapter includes a cone or cone like assembly through which liquid is jetted or sprayed.

2. the trigger actuated liquid pump sprayer as claimed in claim 1, wherein the toggle switch adaptor is movable by rotation.

3. The trigger actuated liquid pump sprayer as claimed in claim 1, wherein the opening is a cut.

4. The trigger actuated liquid pump sprayer as claimed in claim 3, wherein the cut defines at least first and second discharge settings to which the operable portion is movable.

5. The trigger actuated liquid pump sprayer as claimed in claim 4, wherein the at least first and second discharge settings comprise opposing ends of the cut.

6. The trigger actuated liquid pump sprayer as claimed in claim 4, wherein each of the at least first and second discharge settings corresponds to a specific nozzle discharge.

7. The trigger actuated liquid pump sprayer as claimed in claim 6, wherein the specific nozzle discharge of the at least first and second discharge settings comprise two or more of the group comprising: a nozzle closed setting, a jet discharge setting, and a spray discharge setting.

8. The trigger actuated liquid pump sprayer as claimed in claim 5, wherein the operable portion is in a substantially horizontal orientation when moved to either of the opposing ends of the cut.

* * * * *